US009343216B2

(12) United States Patent
Robertson

(10) Patent No.: US 9,343,216 B2
(45) Date of Patent: May 17, 2016

(54) ENERGY EFFICIENT BI-STABLE PERMANENT MAGNET ACTUATION SYSTEM

(71) Applicant: Glen A. Robertson, Madison, AL (US)

(72) Inventor: Glen A. Robertson, Madison, AL (US)

( * ) Notice: Subject to any disclaimer, the term of this patent is extended or adjusted under 35 U.S.C. 154(b) by 9 days.

(21) Appl. No.: 14/016,195

(22) Filed: Sep. 2, 2013

(65) Prior Publication Data

US 2015/0062770 A1 Mar. 5, 2015

(51) Int. Cl.
*H01F 7/16* (2006.01)

(52) U.S. Cl.
CPC ..... *H01F 7/1615* (2013.01); *H01F 2007/1669* (2013.01)

(58) Field of Classification Search
CPC ..... H01F 2007/1669; H01F 7/1872; H01F 7/1615; H01H 33/6662; H01H 47/226
USPC ..... 335/234
See application file for complete search history.

(56) References Cited

U.S. PATENT DOCUMENTS

| | | | | |
|---|---|---|---|---|
| 5,452,172 | A * | 9/1995 | Lane et al. | 361/71 |
| 5,959,826 | A * | 9/1999 | Baurand et al. | 361/156 |
| 6,104,143 | A * | 8/2000 | Bonavia | F02P 3/0884 315/209 CD |
| 8,159,806 | B2 * | 4/2012 | Cartier-Millon et al. | 361/139 |
| 8,569,645 | B2 * | 10/2013 | Bonjean | 218/12 |
| 2012/0175974 | A1 * | 7/2012 | Robertson | 310/12.26 |
| 2013/0328649 | A1 * | 12/2013 | Robertson | 335/234 |
| 2013/0328650 | A1 * | 12/2013 | Robertson | 335/234 |

FOREIGN PATENT DOCUMENTS

GB 2349746 A * 11/2000

* cited by examiner

*Primary Examiner* — Michael Zarroli

(57) ABSTRACT

In a bi-stable permanent magnet actuator system, an electrical circuit arrangement for activating bi-stable permanent magnet actuators that is more adaptable to energy saving power sources, includes a power source that can be of any power level, a voltage conditioner, an energy storage device, an output circuit, and a control circuit for controlling delivery of a discharge current from the energy storage device through the output circuit to the control coil of a bi-stable permanent magnet actuators. Thus, low voltage batteries, solar cells, and energy harvesting devices with low average watts (energy per time) can be used as the power source for bi-stable permanent magnet actuators.

23 Claims, 5 Drawing Sheets

ENERGY EFFICIENT BI-STABLE PERMANENT MAGNET ACTUATION SYSTEM

FIELD OF THE INVENTION

The present invention relates generally to an energy efficient Bi-stable Permanent Magnet Activation System (BSP-MAS) that can be used with various low electrical power sources to deliver short duration discharge current to the control coil of bi-stable permanent magnet actuators like the Dual Position Latching Solenoid of U.S. Pat. No. 3,022,450 and variations thereof, while still allowing bi-stable permanent magnet actuators to have high magnetic field strength, low number of coil turns, and faster armature speed.

BACKGROUND OF THE INVENTION

Bi-stable permanent magnet actuation is a technique employed to move and magnetically hold the armature in electromechanical actuator devices including some valves. In bi-stable permanent magnet actuators, permanent magnets are employed in a manner that places their magnetic field in a bi-stable state to allow the secondary magnetic field produced in a control coil to divert the permanent magnet's magnetic field in one of two directions within the surrounding material.

Typically the activation circuit arrangement for bi-stable permanent magnet actuators use switches connected between the power source and the control coil to alternately direct the current from the power source in one of two directions through the control coil. One switching activation circuit arrangement that can be used with most bi-stable permanent magnet actuators to produce a bi-directional current directly from a power source is an H-bridge, like the one shown in U.S. Pat. No. 4,751,487, FIG. 7, wherein pairs of mechanical switches are simultaneously turned on to deliver the activation current to the control coil. For bi-stable permanent magnet actuators with low magnetic strength permanent magnets, like those of G.B. Pat. No. 2,297,429A and G.B. Pat. No 2,349,746A, activation circuit arrangements like U.S. Pat. No. 4,271,450, U.S. Pat. No. 4,257,081, G.B. 2,349,746A, and E.P. Pat. No. 0,380,089A2 can be used, wherein a capacitor is connected in series with the control coil (generally of a relay) and responsible for providing the reset current as a discharge current therefrom.

These activation circuit arrangements, however, require that the power source be fixed at or above the power required to achieve the desired current or activation current through the control coil. That is, in these activation circuit arrangements, the control coil is the primary power load. Whereby, the source power $P_S=V_AI_A=V_A^2/R$ becomes a function of the control coil's resistance R and the desired voltage or activation voltage $V_A$, where $I_A=V_A/R$ is the activation current. Thus, as the control coil resistance increases, to say $R_2$, with increased number of turns to overcome high magnetic forces by increasing the amp-turns (i.e., the activation current times the number of turns or magnetic force), as would occur in prior art, the new activation voltage $V_{A2}$, thus the increased power $P_{S2}=V_{A2}/R_2=V_{A2}I_{A2}$, would need to be raised to achieve the same activation current $I_A=V^2_{A2}/R_2=V_A/R$. For example, a bi-stable permanent magnet actuator having a control coil with a total resistance of R=10 ohms that requires an activation current of $I_A$=10 Amps at $V_A$=100 Volts would needs a continuous power source of $P_S$=1000 Watts. Then by increasing the number of turns, where say, the resistance increases by $R_2$=25% R, the voltage $V_{A2}$=25% $V_A$, thus power $P_{S2}$=25% $P_S$, would need to increase by 25%. This fact makes high magnetic holding force bi-stable permanent magnet actuators hard to use with energy saving power sources in today's art, like solar power, or with activation circuit arrangements like U.S. Pat. No. 4,271,450, U.S. Pat. No. 4,257,081, G.B. 2,349,746A, E.P. Pat. No. 0,380,089A2 and others in the art, as high magnetic holding force requires high amp-turns or high input power.

What is needed, therefore, is a power source to activation circuit arrangement for bi-stable permanent magnet actuators with high magnetic holding force that is more adaptable to energy saving applications.

In the art of bi-stable permanent magnet latching actuators, there are several bi-stable permanent magnet variations.

One example is the Dual Position Latching Solenoids of U.S. Pat. No. 3,022,450 and variations thereof, having a toroidal permanent magnet and two adjacent control coils that are centrally placed about a magnetic core armature with the permanent magnet radially poled perpendicular to the movement of the magnetic core and incased in a magnetic housing to place the permanent magnet's magnetic field or flux in a bi-stable state in the magnetic core and housing to allow the control coils, when activated, to produce a secondary magnetic field within the magnetic core that alternately diverts the permanent magnet's magnetic field or flux in one of two directions within the magnetic core and housing. Due to the toroidal shape of the permanent magnet, the holding force can be increased by increasing in the magnetic field strength of the permanent magnet or by thickening the permanent magnet without increasing the toroid diameter. This allows the control coil diameters to remain the same. It is understood that the magnetic holding force can also be considerably increased by slightly increasing the permanent magnet's, and thus the actuators, toroid diameter.

Another example is the G.B. pat. No 2297429A, having two linear rows of permanent magnets, one row on either side of an open ended magnetic core armature, and two adjacent control coils about the magnetic core armature with the permanent magnets linearly poled perpendicular to the movement of the magnetic core. Although similar in operation to the Dual Position Latching Solenoid as disclosed in U.S. Pat. No. 3,022,450, in G.B. pat. No 2297429A, the open ended magnetic core allows a large magnetic field or flux loss. As such, the magnetic field or flux from the permanent magnet is directed bi-stable in two directions by the control coils but stable in the loss direction at the open ends of the magnetic core. Increasing the magnetic field strength of the permanent magnets or adding more permanent magnetics lead to increase magnetic field or flux loss at the open ends of the magnetic core. It is understood that this magnetic field or flux loss would require increased magnetic field strength of the permanent magnets and increase power to the control coils over the Dual Position Latching Solenoid as disclosed in U.S. Pat. No. 3,022,450 for equal magnetic holding force.

Many bi-stable permanent magnet latching actuators used in the art today are similar to G.B. pat. No 2349746A or U.S. Pat. No. 6,057,750, having a single, centrally position permanent magnet poled parallel with the movement of a magnetic core armature, and adjacent control coil about the magnetic core armature. Although similar in operation to the Dual Position Latching Solenoid as disclosed in U.S. Pat. No. 3,022,450, in G.B. pat. No 2297429A or U.S. Pat. No. 6,057,750, the single, centrally position permanent magnet and control coil diameter are both subject to the size of the magnetic core. As such, the size and control coil of this type of actuator increases directly with the size of the permanent magnet. It is understood that for or a given permanent magnet type and field strength, the size, control coil and therefore power for this type of actuator increases faster than the Dual Position Latching Solenoid (DPLS) as disclosed in U.S. Pat. No. 3,022,450 for equal magnetic holding force.

Since the power for actuators similar to G.B. Pat. No. 2297429A and G.B. Pat. No. 2349746A increase with magnet size faster than with the DPLS actuators, DPLS actuators provide the best option to use with energy saving power sources at greater magnetic holding forces. However, in the art of bi-stable permanent magnet actuators, the DPLS actuator has not been adopted for use. This fact may actually be due to its higher magnetic holding capability, which limits its size to the low power systems in today's art. What is needed, therefore, is a power source to activation circuit arrangement for bi-stable permanent magnet actuators like DPLS actuators that will make them more applicable for use in today's art of energy savings.

SUMMARY OF THE INVENTION

An activation circuit arrangement is referred to in this specification as a bi-stable permanent magnet actuator system (BSPMAS) that will allow bi-stable permanent magnet actuators more adaptable for activating with energy saving power sources, like solar power and energy harvesting, and specifically useful for activating the Dual Position Latching Solenoid of U.S. Pat. No. 3,022,450 and variations thereof with higher magnetic holding forces over current art, includes: a power source that can be of any power level to include low voltage batteries and solar cells with low average watts (energy per time), a voltage conditioner such as a DC/DC converter, an energy storage device such as a capacitor, an output circuit such as an H-Bridge, and a control circuit for controlling delivery of a discharge current from the energy storage device through the output circuit to the control coil of the bi-stable permanent magnet actuators. The BSPMAS can be made more useful with control coils that are segmented and parallel connected to reduce the input voltage, while increasing the current to the control coils, which can allow the number of coil turns in a bi-stable permanent magnet actuators to be less than normally would be used for the same current in prior art.

By using a voltage conditioner and energy storage device between the power source and the output circuit, the power source is no longer a function of the control coil, but instead of the source power $P_S=V_SI_S=V_SQ_S/t_S=E_S/t_S$, which is a function of the power source energy $E_S=V_S\ I_S\ t_S=V_SQ_S$ that is converted to the discharged power $P_d$, where $V_S$ is the power source voltage and $I_S$ is the current from the power source to delivered a total charge $Q_S$ to the voltage conditioner over time $t_S$. The power source energy $E_S$ is either passed directly from the voltage converter to the energy storage device when $V_S=V_A$ (with $Q_S=Q_C$) or the voltage $V_S$ is converted to the activation voltage $V_A$ and then passed with the converted total charge $Q_C$ to the energy storage device, where $E_S=V_SI_St_S=V_AQ_C$. Whereby, during activation of the bi-stable permanent magnet actuators, the stored energy $E_S$ is delivered as a discharged power $P_d=E_S/t_d=V_dQ_C/t_d=V_dI_d$ over the total discharge time $t_d$, where $V_d$ is the changing discharge voltage and $I_d$ is the changing current. (That is, the current follows a current trace $I_d=P_d/V_d$ similar to FIG. 5, herein.) Noting that the discharged power $P_d=V_dI_d$ is not the peak or activation power $P_A=V_AI_A$, where the peak or activation current $I_A=V_A/R$, which is still a function of the peak activation voltage $V_A$ and the control coil resistance R. Whereby, the peak or activation power $P_A$ is much higher than the power source power $P_S$ and is only one point on the discharged power $P_d$ trace. It is understood that the peak charge $Q_A=I_At_A$ is less than the delivered power source charge $Q_S$ or the stored charge $Q_C$ as the peak or activation current time $t_A<<t_d$, which is typically less than the charge time $t_S$. That is, the charge current $I_S=Q_S/t_S$ can be much smaller than the activation current $I_A=Q_A/t_A$. Whereby and with respect to the power source voltage $V_S$, the power source can be small when the charging time $t_S$ between discharges can be long.

BRIEF DESCRIPTION OF THE DRAWINGS

For a better understanding of the invention, reference is now made to the drawings, wherein like numerals represent similar objects throughout the figures where.

DETAILED DESCRIPTION OF THE INVENTION

Figure 1:
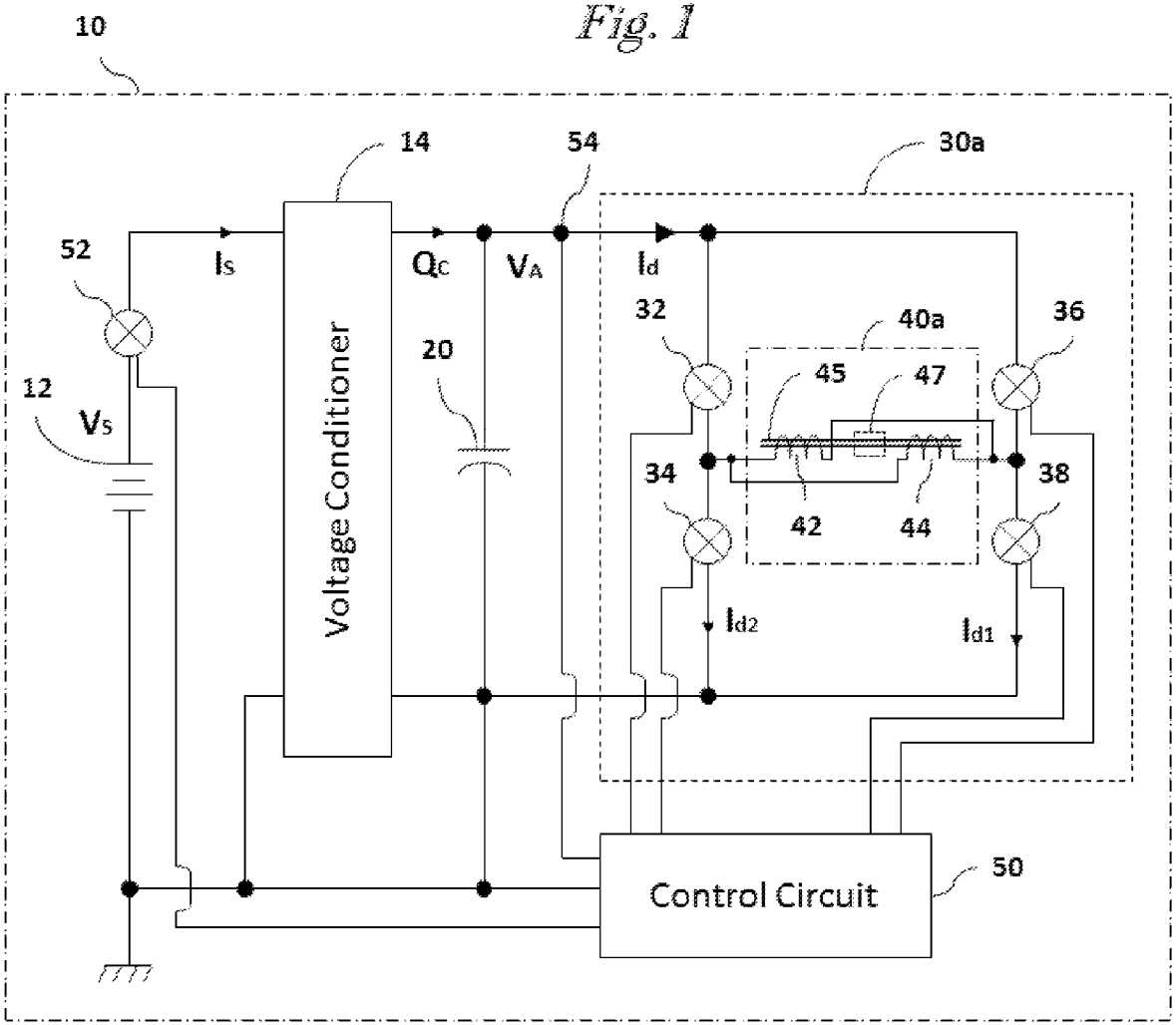
FIGS. 1 and 2 are alternate schematic diagrams of a typical BSPMAS including representation of the control coil, central magnetic core and permanent magnet of a bi-stable permanent magnet actuator.
Figure 2:
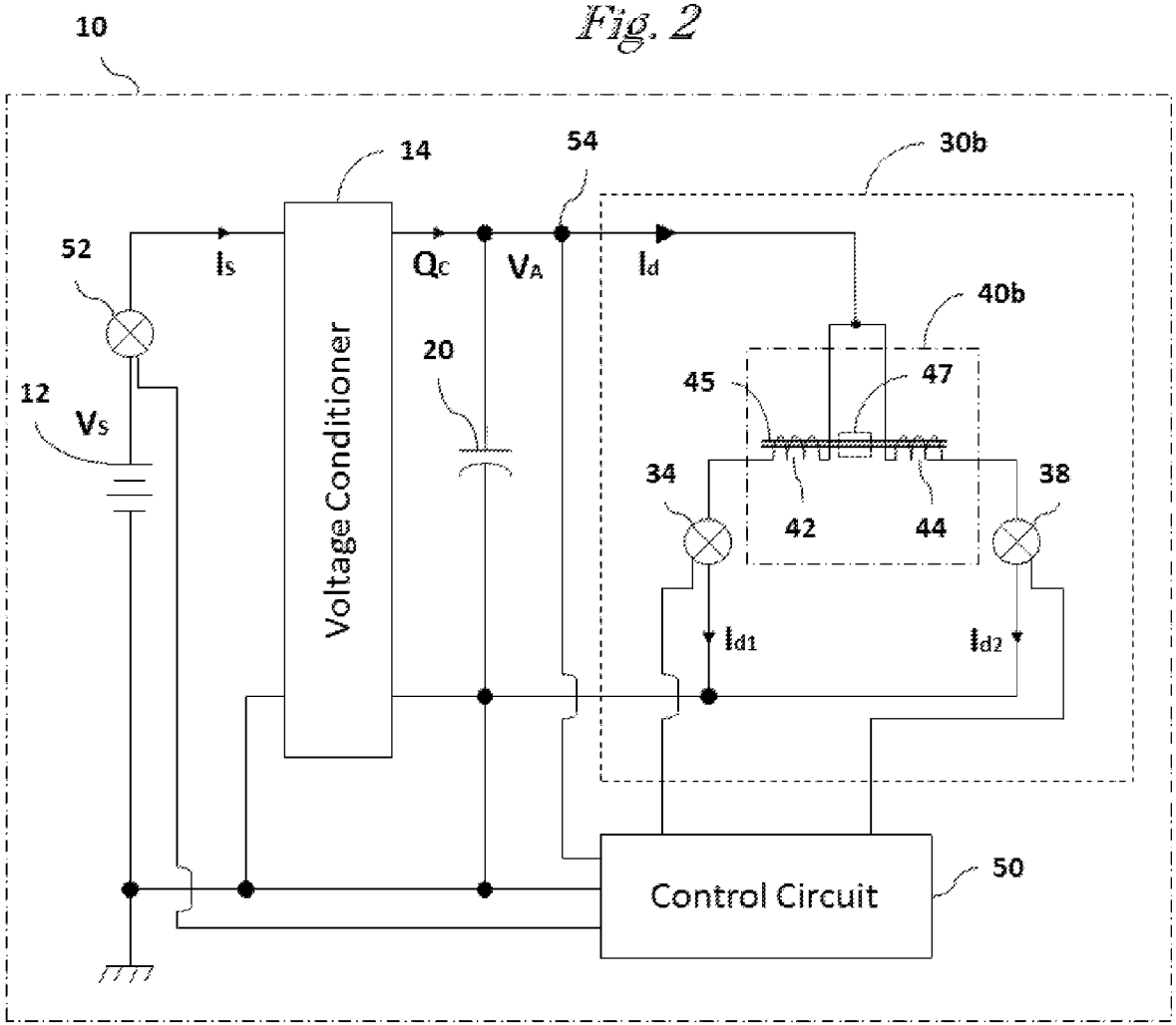

Referring to FIG. 1 and FIG. 2, alternate schematic diagrams of an energy efficient Bi-stable Permanent Magnet Activation System (BSPMAS) 10 are shown including representation of the central magnetic core 45, permanent magnet 47, and control coil 42, 44 of a bi-stable permanent magnet actuators 40. It is understood that the bi-stable permanent magnet actuators 40 can be of any type, but in these figures, the represented central magnetic core 45, permanent magnet 47, and control coil 42, 44 are those specifically of the DPLS actuator of U.S. Pat. No. 3,022,450. BSPMAS 10 includes a power source 12; voltage conditioner 14; electrical energy storage capacitor 20; control circuit 50 including power source switch 52 and voltage sensing point 54; and an output circuit 30*a* of FIG. 1 or 30*b* of FIG. 2. The voltage conditioner 14 converts the power source 12 power $P_S=V_SI_S$ for the energy storage capacitor 20 to the total charge $Q_C$ and the activation voltage $V_A$. The voltage conditioner 14 can be a pass-through if no voltage conditioning is needed, a DC/DC or AC/DC converter, a simple voltage multiplier, or a variety of other voltage conditioning circuits. A unique feature is that if the time between current discharges is long, the power source's 12 input voltage $V_S$ and current $I_S$ can be very small as from low voltage batteries, solar cells, and energy harvesting devices with low average watts (energy $E_S=V_S\ I_S$ times the charging time), whereby a voltage conditioner 14 incorporating a voltage multiplier can step-up the voltage to the storage capacitor 20 over time with a small charge flow to the storage capacitor 20, as indicated by the small arrow on the upper output of the voltage conditioner 14, until the total charge $Q_C$ is reached. Whereas, only the stored energy $E_S=V_AQ_C$ needed for the discharge power $P_d=E_S$ per the discharge time is required to be delivered by the power source 12.

Although FIGS. 1 and 2 shows a single energy storage capacitor 20, it is well-understood in the art that a bank of capacitors may be used, or any other energy storage device that can rapidly release stored electrical energy. It is also well-understood that the voltage on a charging capacitor increases with increased charge, where the total charge $Q_C$ is reached when the activation voltage $V_A$ is reached. It is further well-understood in the art that a variety of voltage sensors can be used in the control circuit 50 to sense the activation voltage $V_A$ at the sensing point 54.

In FIG. 1, the four legs of the output circuit 30*a* are arranged in the form of an "H-bridge, each leg of the output circuit 30*a* having switches 32, 34, 36, and 38, respectively. The output circuit 30*a* is connected to the storage capacitor 20 and the control coil 42, 44 of a bi-stable permanent magnet actuators 40, and is used to deliver the discharge current $I_d$ from the capacitor 20 as indicated by the large arrow bidirectional through the control coil 42, 44. The control circuit 50 detects the activation voltage $V_A$ on the storage capacitor 20 at point 54 and controls the output circuit 30*a* to switch direction of the discharge current $I_P$ to the control coil 42, 44 only when storage capacitor 20 is charged to the activation voltage $V_A$ using switches 32, 34, 36, and 38. A first direction discharge current $I_{d1}$ is discharged through the control coils 42 and 44 from the storage capacitor 20 by activating switches 32 and 38 as indicated by the small arrow. A second direction discharge current $I_{d2}$ in opposite direction through the control coils 42 and 44 to the first discharge current $I_{d1}$ can be discharged from the storage capacitor 20 by activating switches 36 and 34. It is noted that the two control coils 42 and 44 of the bi-stable permanent magnet actuators 40 are shown parallel connected which would reduce the voltage requirement from the voltage conditioner 14 to the storage capacitor 20 over series connected coils. It is understood that the switches may be replaced with multiple switches to reduce the current through each switch. Further it is understood that the BSPMAS 10 of FIG. 1 would still function with bi-stable permanent magnet actuators 40 having only having one coil 42 or 44, as is used in the art of bi-stable permanent magnet actuators.

FIG. 2 presents an alternate version of FIG. 1 with only two switches 34, 38 in the output circuit 30*b*. The output circuit 30*b* is connected to the capacitor 20 and control coil 42, 44, and is used to deliver the discharge current $I_d$ from the capacitor 20 as indicated by the large arrow bidirectional through the control coils 42 or 44. The control circuit 50 detects the activation voltage $V_A$ on the storage capacitor 20 at point 54 and controls the output circuit 30*b* to switch direction of the discharge current $I_d$ to the control coils 42 or 44 only when storage capacitor 20 is charge to the activation voltage $V_A$ using switches 34 and 38, respectfully. A first direction discharge current $I_{d1}$ as indicated by the small arrow through control coil 42 is discharged from the storage capacitor 20 by activating switch 34. A second direction discharge current $I_{d2}$ as indicated by the small arrow through control coil 44 opposite in direction to the first discharge current $I_{d1}$ can be discharged from the storage capacitor 20 by activating switch 38. It is understood that the BSPMAS 10 of FIG. 2 would only have the desired bidirectional function with bi-stable permanent magnet actuators 40 having both control coils 42 and 44. It is also understood that the switches 34, 38 and non-switch side of the control coil could be reversed and still function. Furthermore, it is understood that the switches 34 and 38 may be replaced with multiple switches to reduce the current through each switch. It is well-understood in the art that power source switch 52; output circuit 30*a* switches 32, 34, 36 and 38; and output circuit 30*b* switches 34, and 38, and others incorporated could be a variety of switches from manual (like those shown in U.S. Pat. No. 4,751,487, FIG. 7) or electrically controlled mechanical switches to integrated circuits.

Operation of the BSPMAS 10 of FIG. 1 and FIG. 2 are similar and begin by closing power source switch 52 by control circuit 50 or by an operator if a simple mechanical switch is used to allow current $I_S$ from the power source 12 to inner the voltage conditioner 14. The voltage conditioner 14 conditions the power source voltage $V_S$ and passages total charge $Q_C$ to the storage capacitor 20. The voltage on the storage capacitor 20 will rise until the control circuit 50 senses the activation voltage $V_A$ at point 54 by any of several voltage sensing methods in the art of voltage sensing before activating the output circuit 30*a* or 30*b*.

Figure 3:
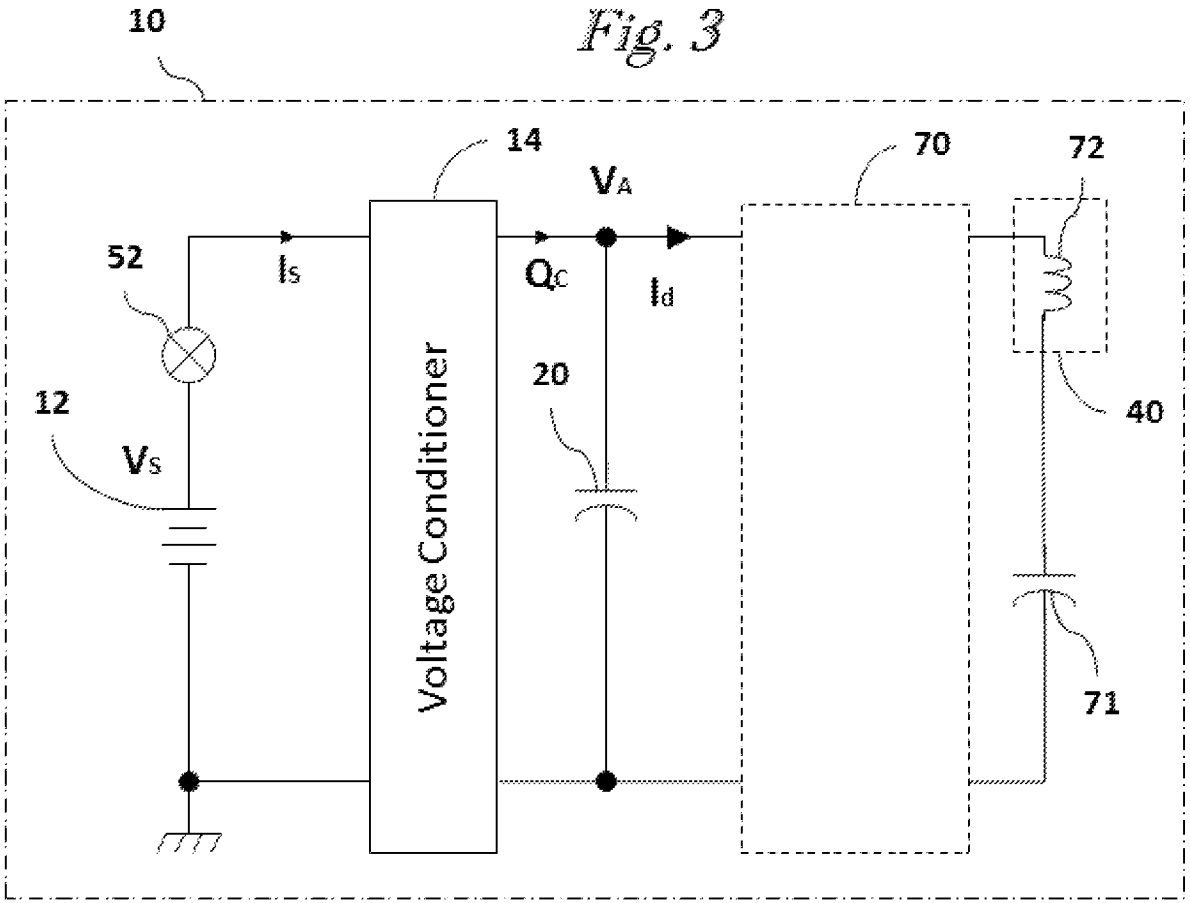
FIG. 3 is an alternate schematic of a BSPMAS that incorporates prior art activation circuit arrangements for control coil of a bi-stable permanent magnet actuator in series connection with a capacitor.

FIG. 3 presents an alternate version of the BSPMAS 10 with the control circuit 50 and output circuit 30*a* or 30*b* integrated into the circuit arrangement 70, where the circuit arrangement 70 is in like to the control and output circuit arrangements in the prior art of bi-stable permanent magnet actuators to include U.S. Pat. No. 4,271,450, U.S. Pat. No. 4,257,081, G.B. 2,349,746A, E.P. Pat. No. 0,380,089A2, and others in the art, wherein a second capacitor 71 is connected in series with the coil 72 representing the control coil of a bi-stable permanent magnet actuator 40, and responsible for providing the reset current as a discharge current therefrom. A voltage sensor by any of several voltage sensing methods in the art of voltage sensing will be needed for those activation circuit arrangements 70 that do not have one to sense the activation voltage $V_A$ on the storage capacitor 20 before activation. Operation of the BSPMAS 10 of FIG. 3 begins by closing power source switch 52 by an operator to allow current $I_S$ from the power source 12 to inner the voltage conditioner 14. The voltage conditioner 14 conditions the power source voltage $V_S$ and passes total charge $Q_C$ to the storage capacitor 20. The voltage on the storage capacitor 20 will rise until the circuit arrangement 70 senses the activation voltage $V_A$ before activating and sending the discharge current $I_d$ through the capacitor 71 and control coil 72. It is understood that when the BSPMAS 10 of FIG. 3 is used with the bi-stable permanent magnet actuator 40 in FIG. 2 it can be used with one control coil 42 or 44, or with the two control coils 42 and 44 connected in series. It is also understood that the power source switch 52 could be one that is controllable by the circuit arrangement 70. Further, it is understood that some circuit arrangement 70 in the art may reduce the power from the storage capacitor 20 to the control coil, whereby the BSPMAS 10 of FIG. 3 would require higher power $P_S=V_SI_S$ than the BSPMAS 10 of FIG. 1 or FIG. 2.

Figure 4:
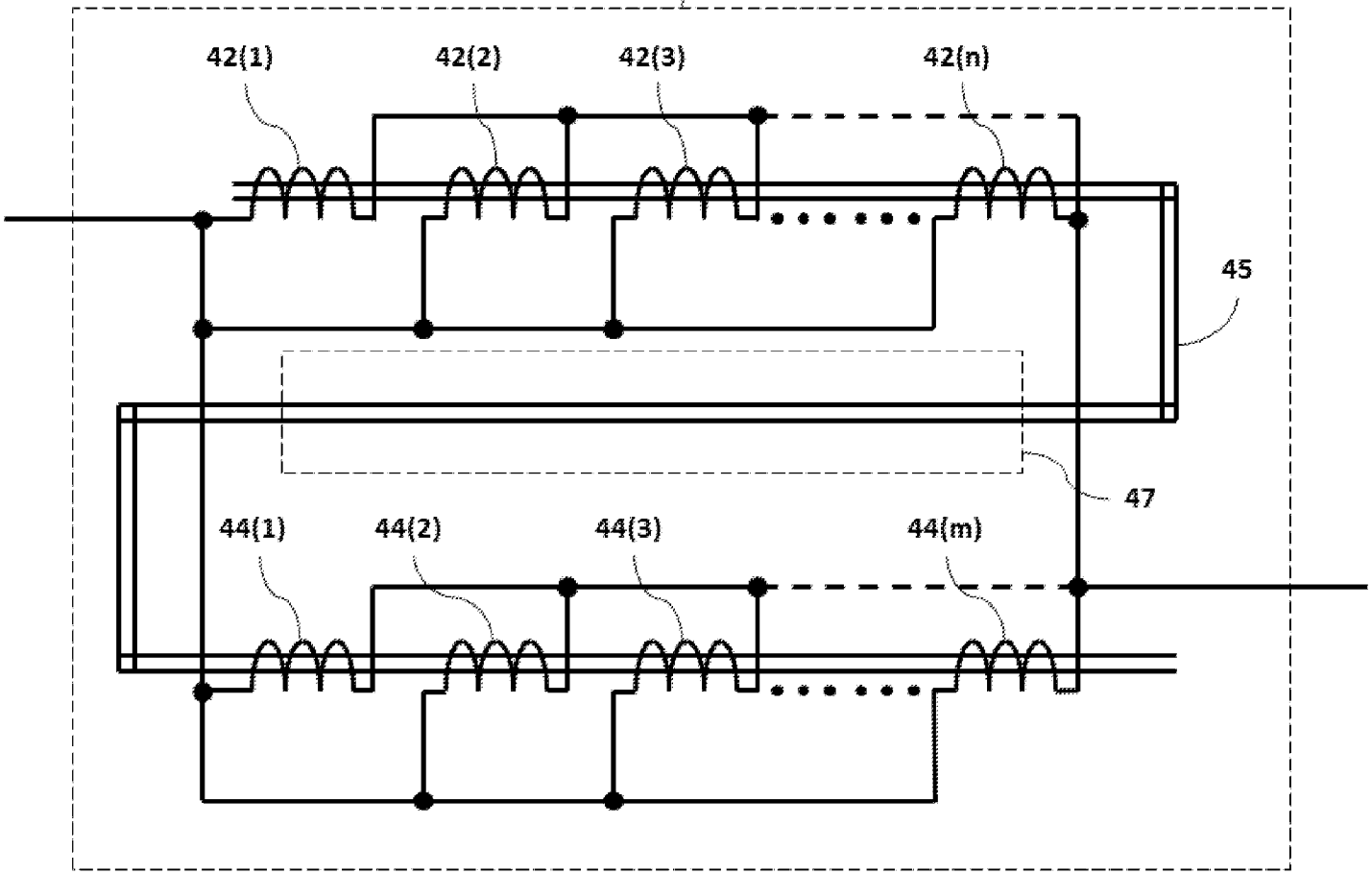
FIG. 4 is an alternate schematic diagram of the control coil of a bi-stable permanent magnet actuator designed to reduce the voltage requirement of a BSPMAS.

Referring now to FIG. 4 with reference to FIG. 1 or FIG. 2, an alternate schematic diagram of the control coils 42 and 44 of the bi-stable permanent magnet actuators 40 designed to reduce the activation voltage $V_A$ from the voltage conditioner 14 to the storage capacitor 20. Control coils 42 and 44 are each divided into parallel connected control coil 42(1), 42(2), 42(3) to 42(*n*) and 44(1), 44(2), 44(3) to 44(*m*), n and m are the maximum number of the coil segments. The maximum number of segments n and m need not be equal if so desired. Unequal maximum number of segments n and m maybe desirable when the magnetic force on one side is needed to be larger than on the other at current activation. All segments 42(1), 42(2), 42(3) to 42(*n*) and 44(1), 44(2), 44(3) to 44(*m*) are placed about the center pole piece 45 of a bi-stable permanent magnet actuator 40 as shown for the control coil in FIG. 1.

For example, a high magnetic holding force bi-stable permanent magnet actuator 40 with a single segment coil 42 with a total turn resistance of R=60 ohms that requires a discharge current of $I_d$=10 Amps at an activation voltage $V_A$=600 Volts would need a pulsed power source of $P_S$=6,000 Watts rated at 600 Volts. With a parallel connected six segment coil 42(1) to 42(6) of total coil resistance of $R_2$=1.67 ohms (R=10 ohms per coil, i.e., 60 ohms total if series connected) that requires a discharge current of $I_{d2}$=60 Amps (~10 Amps through each segment) at an activation voltage $V_{A2}$=100 Volts would need the same pulse power source of 6,000 Watt rated at 100 Volts. That is, a reduction in voltage 6 times smaller. Such a reduction in activation voltage $V_A$ makes the BSPMAS 10 easier to use with energy saving technology, as solar power.

It is understood that the alternate coil design of FIG. 4 may also be used to lower the number of coil turns by increasing the voltage to increase the amperage from the BSPMAS as long as the amperage is below the fusing current (amperage per time) of the coil wire used.

Figure 5:
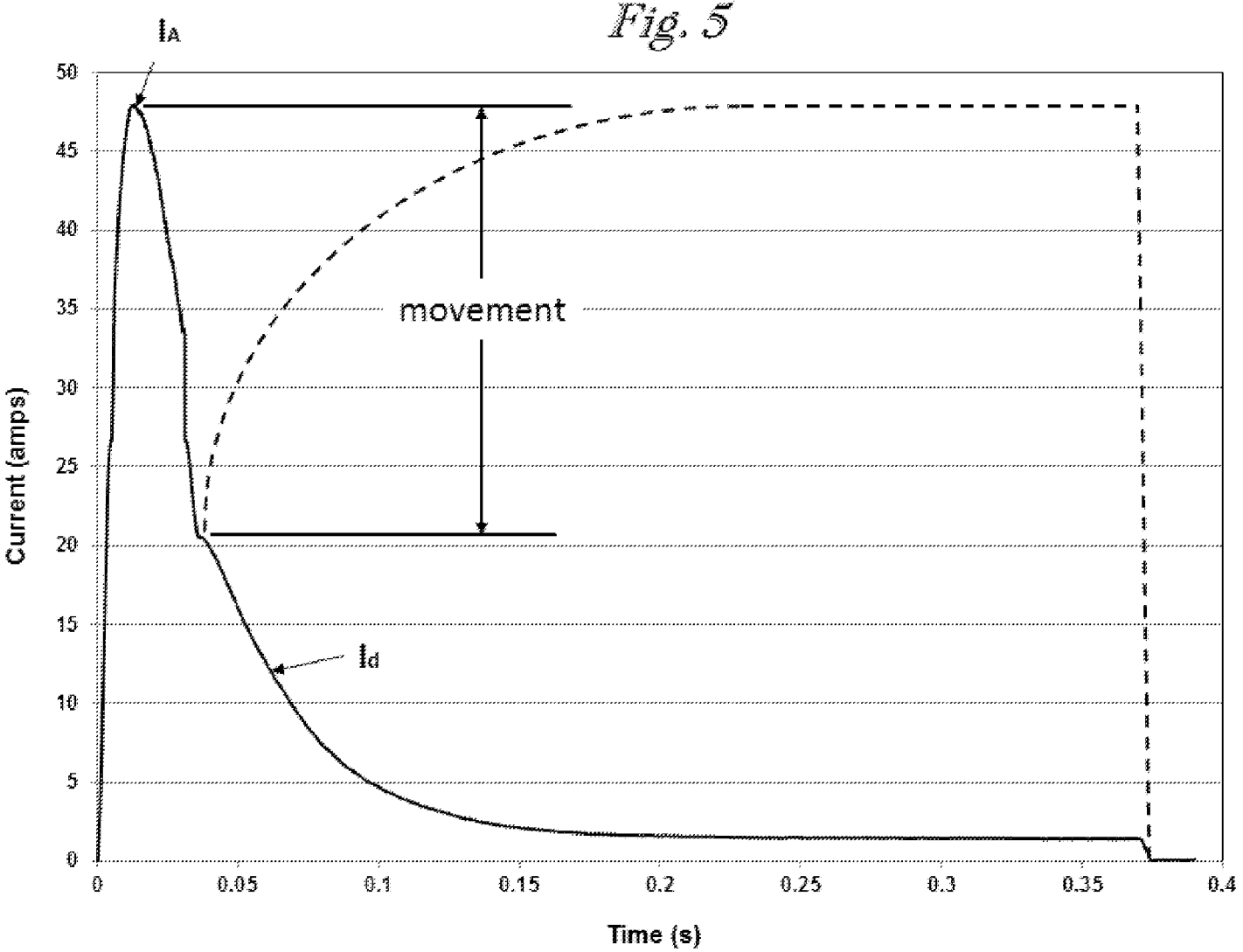
FIG. 5 is a current trace from a 1 k-lb. holding force bi-stable permanent magnet actuator that shows the rapid movement time of the armature using a BSPMAS.

With reference to FIG. 1, typical time durations that the control circuit 50 keeps the discharge current $I_d$ on through output circuit 30*a* or 30*b* can be very small, on order of 10 s of milliseconds. As example of duration time, FIG. 5 shows the discharge current $I_d$ trace through a bi-stable permanent magnet actuator 40*b* as illustrated in FIG. 1 from a bank of four parallel connected 2200 uF capacitors rated at 200V to provide a 8800 uF storage capacitor 20. The storage capacitor 20 was charged to an activation voltage $V_A$=120 V at a rate of 0.1 amps. The bi-stable permanent magnet actuator 40*b* was designed with a high magnetic holding force of approximately 1 k lbs. using rare earth permanent magnets and a bidirectional armature movement of approximately 0.150 inches. The control coils 42 and 44 were wound using 32 awg wire (fusing current 52 A@32 ms, 0.091 amps continuous). Each control coil 42 and 44 was composed of four parallel connected coils according to FIG. 4. The output circuit 30*a* was a mechanical switch (rated at 3 amps, continuous) forming an H-Bridge allowing the time to close to be long (~370 ms). The onset time of the rapid magnetic field build up is from 0 amps to $I_A$ (~15 ms). The armature movement part (~30 ms) of the discharge current $I_d$ trace is shown in FIG. 5 with the current tail-off indicating the drain off of the storage capacitor 20 while the mechanical switch was still closed. The dotted line in FIG. 5 represents the current trace had the power source 12 been from a continuous power supply rated at ~6 k watts. The area between the dotted line and the solid line represents the energy saved. Opposite activation of the control circuit 50 produces a similar but opposite direction discharge current $I_d$ trace with movement of the armature in the opposite direction. It is understood that the power could have been turned off at the end of movement, i.e., at >50 ms.

FIG. 5 illustrates the high amperage and short duration time capability using a BSPMAS. This feature allows current discharges to be high, but less than the fusing current. As illustrated in FIG. 5 for the wire used in the example bi-stable permanent magnet actuator 40*b*, the maximum amperage $I_A$~47.4 amps is less than the fusing amperage of 52 amps@32 ms; noting that the current was only above 20 amps for ~35 ms.

Numerous characteristics and advantages of the invention covered by this document have been set forth in the foregoing description. It will be understood, however, that this disclosure is, in many aspects, only illustrative. Changes may be made in details without exceeding the scope of the invention. The invention's scope is defined in the language in which the appended claims are expressed.

What is claimed is:

1. A Bi-Stable Permanent Magnet Actuation System (BSPMAS) for energy efficient operation of bi-stable permanent magnet actuators (BSPMA) having a certain low number of coil turns in the control coil is characterized by first changing the characteristics of the input power, second storing the converted energy, and third directionally controlling a short duration high discharge current to said control coil of said BSPMA comprising:

a power source;

a power source switch to turn on or off the power source;

a voltage conditioner that changes the input electrical energy characteristic by converting the input voltage from the power source to the output voltage for operation of said BSPMA;

an energy storage device to receive and store the output electrical energy from the voltage conditioner and to deliver the short duration discharge current to said control coil of said BSPMA having a maximum amperage higher than the continuous amperage limit and lower than the fusing current of the coil wire in said control coil of said BSPMA, and having a certain high amperage to achieve the amp-turns or magnetic force desired in said BSPMA for operation with the certain low number of coil turns in said control coil of said BSPMA;

a voltage sensing point for monitoring the voltage on the energy storage device;

an output circuit containing two or more switches coupled to the energy storage device and said control coil of said BSPMA to direct the discharge current from the energy storage device in one of two directions to said control coil of said BSPMA;

and a control circuit having at least a voltage sensor;

where when the power source switch is remotely turned on by the control circuit or manually turned on by an operator, power from the power source is directed to the voltage conditioner, which sends converted electrical energy to the energy storage device, while the voltage sensor in the control circuit monitors the voltage sensing point for the output voltage needed to operate said BSPMA; and when the output voltage is reached, a first one or more switches in the output circuit are remotely turned on by the control circuit or manually turned on by an operator to direct the discharge current from the energy storage device in one of two directions to said control coil of said BSPMA, while a second one or more switches in the output circuit are turned off; opposite directionality of the discharge current from the energy storage device to said control coil of said BSPMA is obtained by remotely turning on by the control circuit or manually turning on by an operator the second one or more switches in the output circuit, while the first one or more switches in the output circuit are turned off;

thus to provide the short duration discharge current for energy efficient operation of said BSPMA and having amperage for operating said BSPMA with the certain low number of coil turns in said control coil of said BSPMA.

2. A Bi-Stable Permanent Magnet Actuation System (BSPMAS) for energy efficient operation of bi-stable permanent magnet actuators (BSPMA) having a certain high magnetic strength permanent magnet that correspondingly provides a high magnetic latching force is characterized by first changing the characteristics of the input power, second storing the converted energy, and third directionally controlling a short duration high discharge current to the control coil of said BSPMA comprising:

a power source;

a power source switch to turn on or off the power source;

a voltage conditioner that changes the input electrical energy characteristic by converting the input voltage from the power source to the output voltage for operation of said BSPMA;

an energy storage device to receive and store the output electrical energy from the voltage conditioner and to deliver the short duration discharge current having a maximum amperage higher than the continuous amperage limit and lower than the fusing current of the coil wire in said control coil of said BSPMA, and having a certain high amperage to achieve the amp-turns or magnetic force desired in said BSPMA for operation with a certain high magnetic strength permanent magnet;

a voltage sensing point for monitoring the voltage on the energy storage device;

an output circuit containing two or more switches coupled to the energy storage device and said control coil of said BSPMA to direct the discharge current from the energy storage device in one of two directions to said control coil of said BSPMA;

and a control circuit having at least a voltage sensor;

where when the power source switch is remotely turned on by the control circuit or manually turned on by an operator, power from the power source is directed to the voltage conditioner, which sends converted electrical energy to the energy storage device, while the voltage sensor in the control circuit monitors the voltage sensing point for the output voltage needed to operate said BSPMA; and when the output voltage is reached, a first one or more switches in the output circuit are remotely turned on by the control circuit or manually turned on by an operator to direct the discharge current from the energy storage device in one of two directions to said control coil of said BSPMA, while a second one or more switches in the output circuit are turned off; opposite directionality of the discharge current from the energy storage device to said control coil of said BSPMA is obtained by remotely turning on by the control circuit or manually turning on by an operator the second one or more switches in the output circuit, while the first one or more switches in the output circuit are turned off;

thus to providing the short duration discharge current for energy efficient operation of said BSPMA and having amperage for operating said BSPMA with the certain high magnetic strength permanent magnet that correspondingly provides the high magnetic latching force.

3. A Bi-Stable Permanent Magnet Actuation System (BSPMAS) for energy efficient operation of bi-stable permanent magnet actuators (BSPMA) having a certain short movement time of an armature in said BSPMA is characterized by first changing the characteristics of the input power, second storing the converted energy, and third directionally controlling a short duration high discharge current to the control coil of said BSPMA comprising:

a power source;

a power source switch to turn on or off the power source;

a voltage conditioner that changes the input electrical energy characteristic by converting the input voltage from the power source to the output voltage for operation of said BSPMA;

an energy storage device to receive and store the output electrical energy from the voltage conditioner and to deliver the short duration discharge current having a maximum amperage higher than the continuous amperage limit and lower than the fusing current of the coil wire in said control coil of said BSPMA, and having a certain high amperage to achieve the amp-turns or magnetic force desired in said BSPMA for operation with the certain short movement time of said armature of said BSPMA;

a voltage sensing point for monitoring the voltage on the energy storage device;

an output circuit containing two or more switches coupled to the energy storage device and said control coil of said BSPMA to direct the discharge current from the energy storage device in one of two directions to said control coil of said BSPMA;

and a control circuit having at least a voltage sensor;

where when the power source switch is remotely turned on by the control circuit or manually turned on by an operator, power from the power source is directed to the voltage conditioner, which sends converted electrical energy to the energy storage device, while the voltage sensor in the control circuit monitors the voltage sensing point for the output voltage needed to operate said BSPMA; and when the output voltage is reached, a first one or more switches in the output circuit are remotely turned on by the control circuit or manually turned on by an operator to direct the discharge current from the energy storage device in one of two directions to said control coil of said BSPMA, while a second one or more switches in the output circuit are turned off; opposite directionality of the discharge current from the energy storage device to said control coil of said BSPMA is obtained by remotely turning on by the control circuit or manually turning on by an operator the second one or more switches in the output circuit, while the first one or more switches in the output circuit are turned off;

thus to provide the short duration discharge current for energy efficient operation of said BSPMA and having amperage for operating said BSPMA with certain short movement times of said armature.

4. A Bi-Stable Permanent Magnet Actuation System (BSPMAS) for energy efficient operation of bi-stable permanent magnet actuators (BSPMA) using certain control and output (CO) circuit arrangement used with a series connected control coil and capacitor for operation of bi-stable permanent magnet actuators (BSPMA) is characterized by first changing the characteristics of the input power, second storing the converted energy, and third controlling a short duration and alternating discharge current through the series connected said control coil of said BSPMA and capacitor comprising:

a power source;

a power source switch to turn on or off the power source;

a voltage conditioner that changes the input electrical energy characteristic by converting the input voltage from the power source to the output voltage for operation of said BSPMA;

an energy storage device to receive and store the output electrical energy from the voltage conditioner and to deliver the discharge current to the certain CO circuit arrangement having a maximum amperage equal or higher than the continuous amperage limit and lower than the fusing current of the coil wire in said control coil of said BSPMA, and having an amperage lower than the destructive current limit of the certain CO circuit arrangement;

a certain CO circuit arrangement used with the series connected control coil and capacitor and having a voltage sensor;

and a capacitor coupled to the certain CO circuit arrangement and in series with said control coil of said BSPMA that is capable of storing the electrical energy from the discharge current that is passed through the certain CO circuit arrangement and said control coil of said BSPMA;

where when the power source switch is remotely turned on by the certain CO circuit arrangement or manually turned on by an operator, power from the power source is directed to the voltage conditioner, which sends converted electrical energy to the energy storage device, while the voltage sensor in the certain CO circuit arrangement monitors the voltage on the energy storage device, where at the output voltage needed to operate said BSPMA; the certain CO circuit arrangement directs the discharge current from the energy storage device through the certain CO circuit arrangement and said control coil of said BSPMA and into the series connected capacitor, opposite directionality of the discharge current is achieved by the certain CO circuit arrangement allowing the electrical energy stored on the series connected capacitor to flow back as a discharge current through the said control coil of said BSPMA and into the certain CO circuit arrangement;

thus to provide the short duration and alternating discharge current for energy efficient operation of said BSPMAS using certain CO circuit arrangements used with the series connected control coil and capacitor.

5. The BSPMAS of claims 1, 2, 3 or 4, wherein the power source is an energy saving or low energy power source.

6. The BSPMAS of claim 1, 2 or 3, wherein the output circuit is an H-bridge comprising two sets of switches that are remotely turned on or off by the control circuit or manually turned on or off by an operator, where the first set of two switches are simultaneously turned on with the second set of two switches turned off to discharge the short duration high discharge current from the energy storage device in one of two direction to said control coil of said BSPMA with opposite current direction obtained when the second set of two switches are turned on with the first set of two switches turned off.

7. The BSPMAS of claim 1, 2, 3 or 4, wherein the voltage conditioner has a certain low voltage output and the energy storage device has a certain high energy capacitance, thus to allow said control coil of said BSPMA to be composed of a plurality of parallel connected coils that lowers the total resistance of said control coil of said BSPMA to produce the high discharge current from the storage device at a certain low voltage from the voltage conditioner.

8. The BSPMAS of claim 1, 2, 3 or 4, wherein the output circuit contains two switches that can be remotely by the control circuit or manually by an operator turned on or off for use with said BSPMA having said control coil comprising two independent coils with each said coil wound in opposite direction to allow the discharge current from the energy storage device to produce opposite directional current flow in each coil;

Where the first switch is turned on with the second switch turned off to direct the discharge current from the energy storage device to the first said coil in said control coil of said BSPMA, and the second switch is turned on with the first switch turned off to direct the discharge current from the energy storage device to the second said coil in said control coil of said BSPMA.

9. The BSPMAS of claims 1, 2, 3 or 4, wherein the energy storage device further comprises at least one capacitor.

10. The BSPMAS of claims 1, 2, 3 or 4, wherein the switches further comprises at least one manually controllable mechanical switch.

11. The BSPMAS of claims 1, 2, 3 or 4, wherein the switches further comprises at least one electrically controllable mechanical switch.

12. The BSPMAS of claims 1, 2, 3 or 4, wherein the switches further comprises at least one SCR.

13. The BSPMAS of claims 1, 2, 3 or 4, wherein the switches further comprises at least one IGBT.

14. The BSPMAS of claims 1, 2, 3 or 4, wherein the switches further comprises at least one MOSFET.

15. The BSPMAS of claims 1, 2, 3 or 4, wherein the switches further comprises at least one Transistor.

16. The BSPMAS of claims 1, 2, 3 or 4, wherein the switches further comprises at least one Thyristor.

17. The BSPMAS of claims 1, 2, 3 or 4, wherein the voltage conditioner further comprises a voltage multiplier.

18. The BSPMAS of claims 1, 2, 3 or 4, wherein the voltage conditioner further comprises a DC/DC converter.

19. The BSPMAS of claims 1, 2, 3 or 4, wherein the voltage conditioner further comprises an AC/DC converter.

20. The BSPMAS of claims 1, 2, 3 or 4, wherein the voltage conditioner passes the current and voltage from a DC power source to the storage device.

21. The BSPMAS of claims 1, 2, 3 or 4, wherein the voltage conditioner rectifies AC power from an AC power source to produce DC power to the storage device.

22. The BSPMAS of claims 1, 2, 3 or 4, wherein the voltage conditioner steps-down the voltage from the power source to the storage device.

23. The BSPMAS of claims 1, 2, 3 or 4, wherein the voltage conditioner steps-up the voltage from the power source to the storage device.

* * * * *